US007431102B2

(12) United States Patent
Hua et al.

(10) Patent No.: US 7,431,102 B2
(45) Date of Patent: Oct. 7, 2008

(54) SWITCHOVER MECHANISM FOR A REVERSIBLE CONTROL VALVE OF A PNEUMATIC TOOL

(75) Inventors: Chiang Hua, Taichung (TW); Ming-Chuan Lin, Taichung (TW)

(73) Assignee: Basso Industry Corp., Taichung (TW)

( * ) Notice: Subject to any disclaimer, the term of this patent is extended or adjusted under 35 U.S.C. 154(b) by 333 days.

(21) Appl. No.: 11/327,749

(22) Filed: Jan. 9, 2006

(65) Prior Publication Data

US 2007/0011884 A1 Jan. 18, 2007

(30) Foreign Application Priority Data

Jun. 29, 2005 (TW) ..... 94121916 A

(51) Int. Cl.
*B25B 19/00* (2006.01)

(52) U.S. Cl. ..... 173/169; 173/104; 173/218

(58) Field of Classification Search ..... 173/104, 173/169, 168, 218, 221, 166
See application file for complete search history.

(56) References Cited

U.S. PATENT DOCUMENTS 5,918,686 A * 7/1999 Izumisawa ..... 173/20
6,044,917 A * 4/2000 Brunhoelzl ..... 173/93.5
6,062,323 A * 5/2000 Pusateri et al. ..... 173/169
7,032,881 B1 * 4/2006 Chiang ..... 251/263
7,222,680 B2 * 5/2007 Livingston et al. ..... 173/177
7,311,155 B2 * 12/2007 Chang et al. ..... 173/104
2003/0010513 A1 * 1/2003 Taga ..... 173/168
2004/0231868 A1 * 11/2004 Hall ..... 173/169
2007/0131441 A1 * 6/2007 Chang ..... 173/104
2007/0137873 A1 * 6/2007 Livingston et al. ..... 173/104

* cited by examiner

*Primary Examiner*—Brian D Nash
(74) *Attorney, Agent, or Firm*—Egbert Law Offices

(57) ABSTRACT

The switch mechanism for the reversible control valve of the pneumatic tool focuses on the switchover bar because of the users' right handed and left-handed issues. The primary feature is to make the switchover bar of the reversible control valve and the speed-adjusting valve to roll in the axial direction, and use the combination of the elastic component to make the combination and position section of the connecting section to position with the valve bar positioning section of the reversible control valve. When force of the connecting section of the switchover bar is pulled toward external trigger, it can release the combination and position section and the toggle switch of the switchover bar can achieve switching. When the toggle switch is adjusted, the repositioning may be restored by using the combination and position section and valve bar positioning section without having to take the parts apart.

12 Claims, 11 Drawing Sheets

SWITCHOVER MECHANISM FOR A REVERSIBLE CONTROL VALVE OF A PNEUMATIC TOOL

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates generally to a pneumatic tool, and more particularly to a device that has a switchover mechanism for a reversible control valve.

BACKGROUND OF THE INVENTION

Because a common pneumatic tool, such as a pneumatic handle, has a difference between tightening the screws and loosening the screws when in use, the tool reacts to the direction the pneumatic tool turns, which is tightening when turning clockwise, and loosening when turning counterclockwise. Because it must have these two functions, the structure of the pneumatic tool must have a switch design that has reversible control, and usually this is achieved by placing a reversible control. Moreover, a switchover control must be placed on the outside of the pneumatic tool and connected to the reversible control valve mentioned above for users to operate.

The present invention attempts to solve the above-mentioned problems. First, the most common structure for the switchover control is to design the switchover control like a bar, and the bar coordinates with the position of the fingers when holding the pneumatic tool, so that it protrudes and leans toward the left side of the handle of the pneumatic tool. By so doing, the user may use the thumb of the right hand to control it while holding it with the right hand. Even though there are more right handed users in the society, the convenience for left-handed users must be considered. For this reason, when the manufacturers produce the product, they must assemble some models for the left-handed users, even though the user only needs to "switch" the bar for the switchover control to the right side of the hand of the pneumatic tool for the left-handed users to operation. Because the switch mechanism for the reversible control valve of today's pneumatic tool has not considered the need mentioned above, it still has the existing "switching" difficulty. The analysis for this point is described as follows.

Besides the connection of the switchover control, the reversible control valve of the conventional pneumatic tool is usually connected with the speed-adjusting valve, a trigger, that controls the opening and closing of the air way, and the trigger bar. When the reversible control valve is assembled into the slot preset on the handle of the pneumatic tool, it is fixed by a bolt, and this positioning made other parts, such as the switchover control, speed-adjusting valve and trigger bar, that are connected to it, become fixed. Therefore, when the switchover control needs to be adjusted to the relative angle due to the demand of "switching" mentioned above, because it is connected to other components, it cannot be achieved. It must first take the bolt off, and the positions of the parts are released to be able to adjust the switchover control to another relative angle to achieve the purpose of switching. Thus, this conventional structure is time consuming for switching the switchover control, and for the user that does not have the assisting tool, it becomes difficult and inconvenient when the circumstances of right handed and left-handed users occur.

Thus, to overcome the aforementioned problems of the prior art, it would be an advancement if the art to provide an improved structure that can significantly improve the efficacy.

To this end, the inventor has provided the present invention of practicability after deliberate design and evaluation based on years of experience in the production, development and design of related products.

BRIEF SUMMARY OF THE INVENTION

The issue disclosed in the previous section mentioned that the parts of the switchover bar of the reversible control valve of the pneumatic tool must be taken apart completely before it can switch because of the users' right handedness and left-handedness. In comparison, the connecting section 21 of the switchover bar 20 of the present invention can be solved by using the positioning or releasing of the combination of the combination and position section 23 and the valve bar positioning section 14 of the reversible control valve 10, and further using the repositioning function for the elastic component 60 and speed-adjusting valve 30 that coordinate with the outward movement of the switchover bar 20 to make the switching of the toggle switch 22 of the switchover bar 20 easier and faster without having to take the parts apart, and without assisting tools. For the industry and users, it makes the switching more convenient and practical.

Although the invention has been explained in relation to its preferred embodiment, it is to be understood that many other possible modifications and variations can be made without departing from the spirit and scope of the invention as hereinafter claimed.

DETAILED DESCRIPTION OF THE INVENTION

The features and the advantages of the present invention will be more readily understood upon a thoughtful deliberation of the following detailed description of a preferred embodiment of the present invention with reference to the accompanying drawings.

As shown in FIGS. 1-4, a switchover mechanism for the reversible control valve of a pneumatic tool, in which a pneumatic tool (A) is a pneumatic handle. The purpose for the reversible control valve is to be able to reverse the switch for the switchover bar without having to take of the reversible control valve, so that it can quickly be change to left-handed mode or right handed mode.

Figure 5:
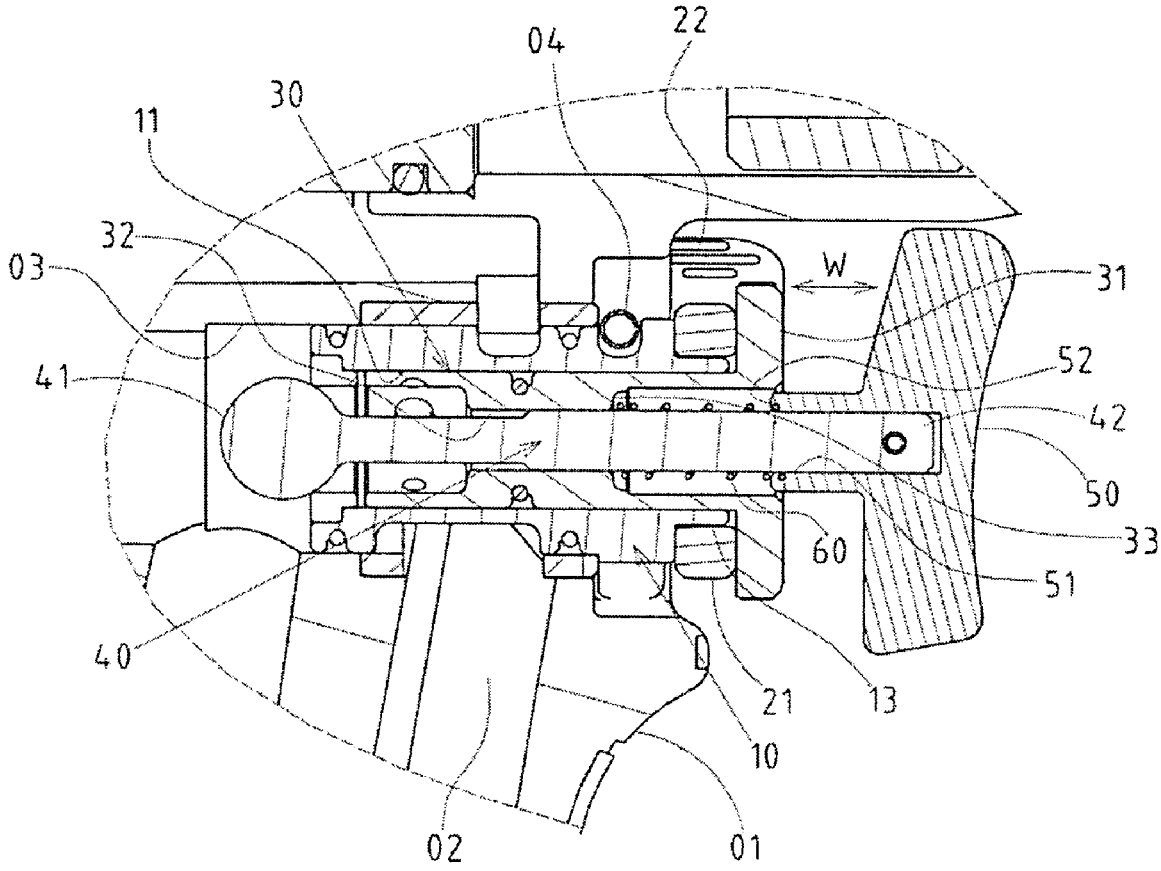
FIG. 5 shows an enlarged sectional view of the parts of the reversible control valve in FIG. 3.

The invention includes a reversible control valve 10, which is a hollow cylinder that has a through slit 11 in the center, and it is placed in the horizontal slot 01 (as shown in FIG. 5) on the air inlet channel 02 of the handle 01 of the pneumatic tool A. However, the direction of its axle is positioned by using a bolt 04 bolted horizontally to the handle 01, and the inner wall of the reversible control valve 10 has an air hole 12. The external end of the reversible control valve 10 has a protruding tube 13 sticking out to the external side of the handle. A valve bar positioning section 14 is placed on the external side of the reversible control valve 10, and the valve bar positioning section 14 of the present embodiment is shaped as concave slots on both sides of the protruding tube 13.

There is a switchover bar 20, which includes a connecting section 21 and a toggle switch 22, and the connecting section 21 of the present embodiment is a round cylinder that can be connected to the protruding tube 13 of the external end of the reversible control valve 10. The inside of the connecting section 21 has a combination and position section 23 that can be positioned with the valve bar positioning section 14 that is on the outside of the reversible control valve 10. The combination and position section 23 of the present embodiment is placed on the two sides of the connecting section 21 and become protruding blocks that are 180° apart, which can be positioned with the valve bar positioning section 14 mentioned above. Moreover, the toggle switch 22 of the switchover bar 20 is facing one side of the handle 01 (right side or left side) extended, and the toggle switch is shaped for the user's hands, being an expanded plate in the present embodiment. In so doing, when switching the toggle switch 22, it can turn with the reversible control valve 10 by the combination of the combination and position section 23 mentioned above, and the valve bar positioning section 14, and further change the relative angle of the air flow channel 02 made by the air hole 12 and pneumatic tool A to achieve the reversible control for the pneumatic tool.

A speed-adjusting valve 30, which has a hollow cylinder shape, is placed in the through slit 11 of the reversible control valve 10, and makes it turn and roll in the axial direction. On the external side, the speed-adjusting valve 30 has a control wheel 31 that has an expanded outer diameter, and the control wheel is placed on the outside of the connecting section 21 of the switchover bar to keep the speed-adjusting valve from rolling inward and create limiting function. It also keeps the switchover bar 20 from moving outward and creates a limiting function. A through hole 32 is placed in the center of the speed-adjusting valve 30, and the outside of the through hole has a section of an expanded diameter that shapes a shoulder 33.

There is a trigger bar 40, which is a bar shape, and its stick rolls through the through hole 32 of the speed-adjusting valve 30. A limit block 41 is placed inside the trigger bar 40 (an expanded ball shape in the present embodiment) to block the inside of the through slit 11 of the reversible control valve 10, so that the trigger bar 40 can not continue to roll out. The external side of the trigger bar 40 protrudes out from the outside of the handle as long as the length of the through hole 32 of the speed-adjusting valve 30 to shape a trigger connector 42.

A trigger 50 is made with a button like body, and its inside has a sleeving hole 51 for connecting to the trigger connector 42 on the external end of the trigger bar 40 for a human hand to open the air pressure channel. A distance W (as shown FIG. 5) is placed between the trigger 50 and the control wheel of the speed-adjusting valve 30.

An elastic component 60 in the present embodiment is a spiral spring, which is placed between the shoulder 33 of the through hole 32 of the speed-adjusting valve 30 and the internal surface 52 of the trigger 50. It pushes the trigger 50 outward and pushes the speed-adjusting valve 30 inward so that the control wheel 31 of the speed-adjusting valve 30 pushes against the connecting section 21 of the switchover bar 20. The combination and position section 23 inside the connecting section 21 can be positioned with the valve bar positioning section 14 of the reversible control valve 10.

Through the above structure and design, the operation of the reversible control valve of the pneumatic tool disclosed by the present is explained as follows.

Figure 1:
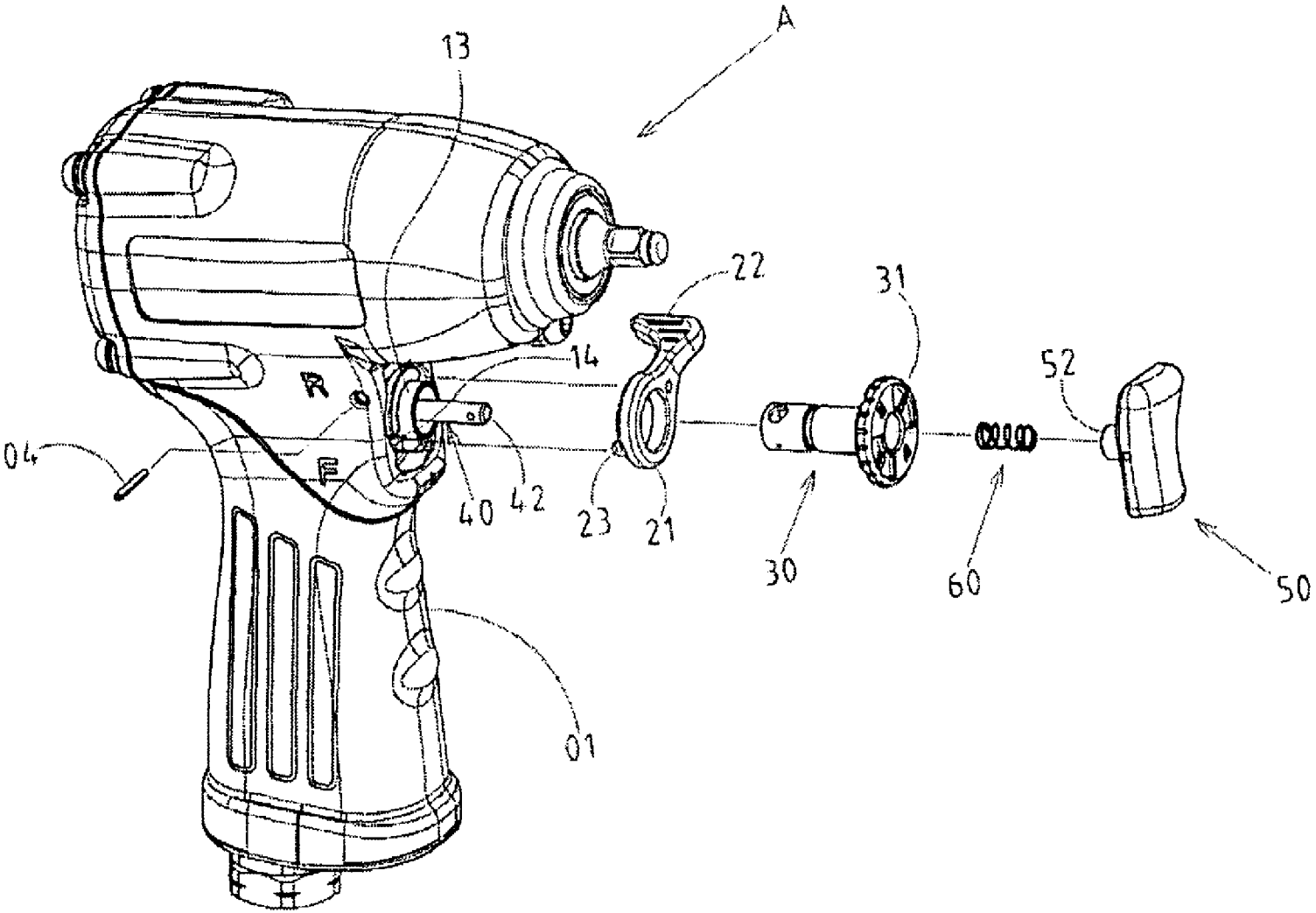
FIG. 1 shows an exploded perspective view of the parts of the pneumatic tool and reversible control valve of the present invention.
Figure 2:
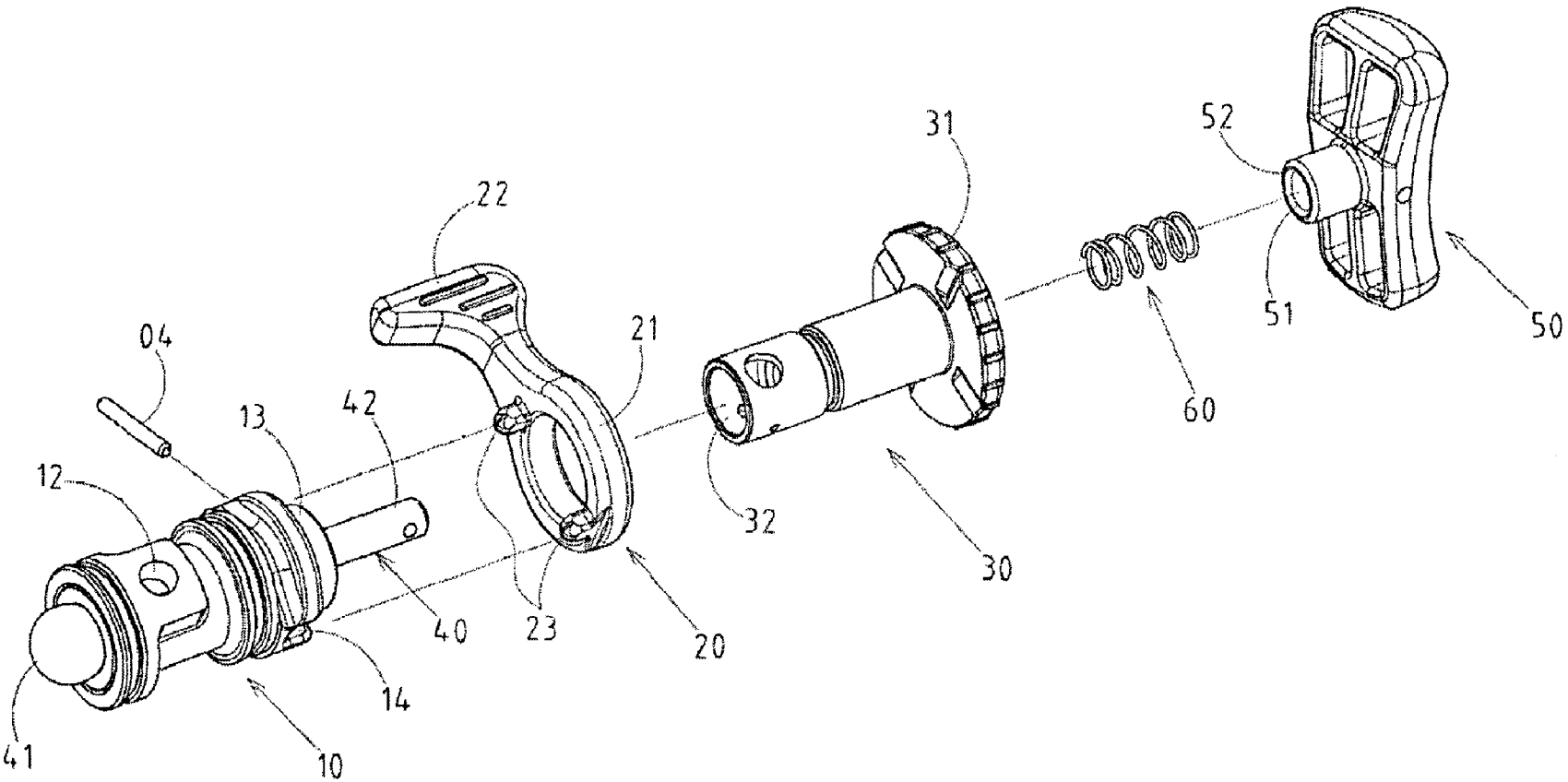
FIG. 2 shows an exploded perspective view of the parts of the reversible control valve of the present invention.
Figure 4:
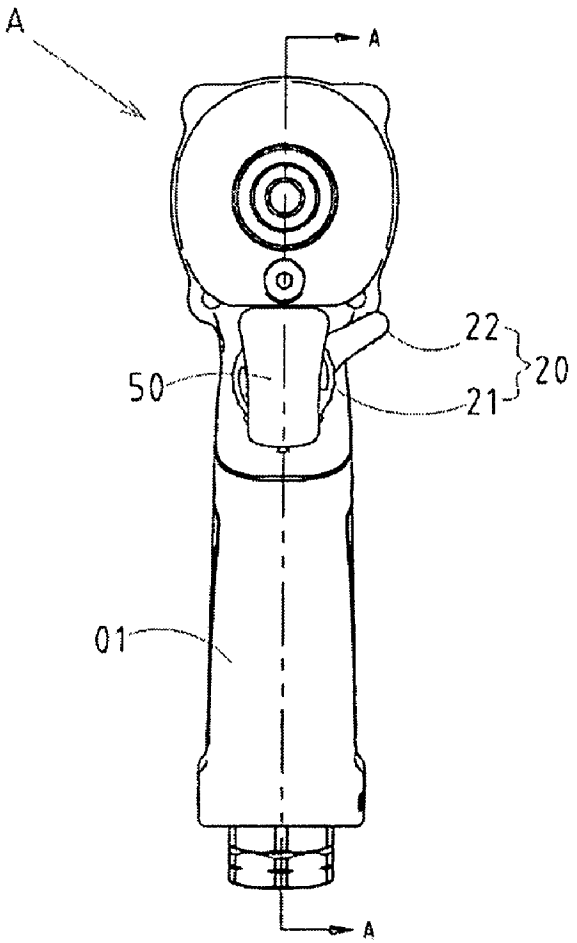
FIG. 4 shows a front elevation view of the pneumatic tool in FIG. 3.
Figure 3:
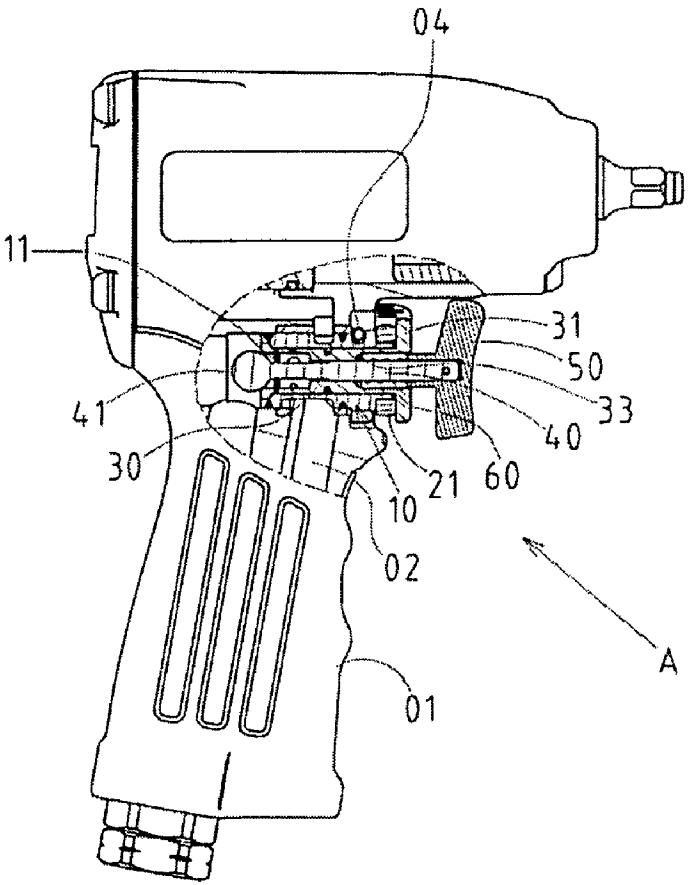
FIG. 3 shows a sectional view of the parts of the reversible control valve of the present invention along line A-A of FIG. 4, the toggle switch of the switchover bar being located on the right side of the handle.

As shown in FIGS. 3, 4, 5, the toggle switch 22 of the switchover bar 20 are located in the right side of the handle 01 (as shown in the figures), and these figures show a structure that is used by right handed users. As shown in FIG. 5, pushing by the elastic component 60, the inside of the control wheel 31 of the speed-adjusting valve 30 may be pushed against the outside of the connecting section 21 of the switchover bar 20, and the combination and position section 22 inside the connecting section 21 may be maintained by connecting with the valve bar positioning section 14 of the reversible control valve 10 (as shown in FIG. 2).

Figure 7:
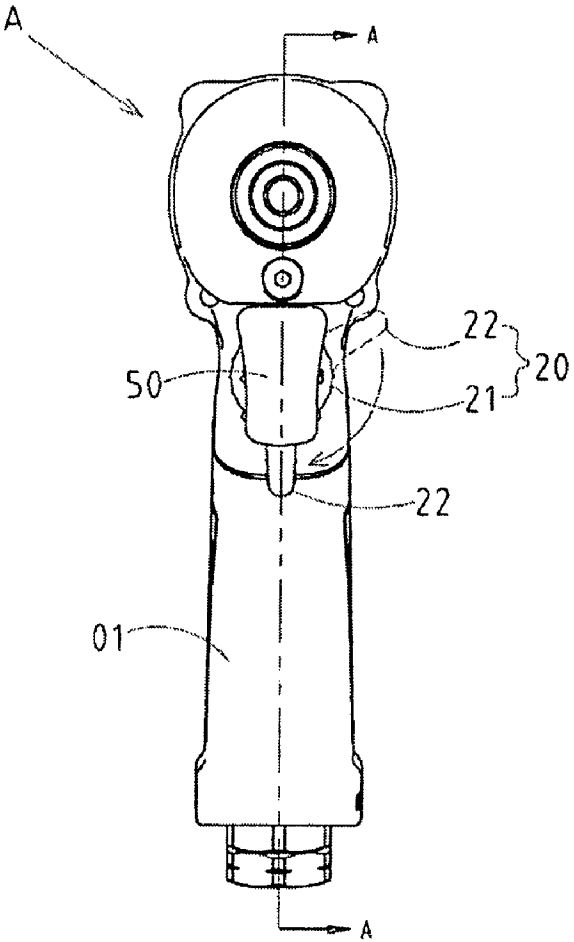
FIG. 7 shows a front elevation view of the pneumatic tool in FIG. 6.
Figure 6:
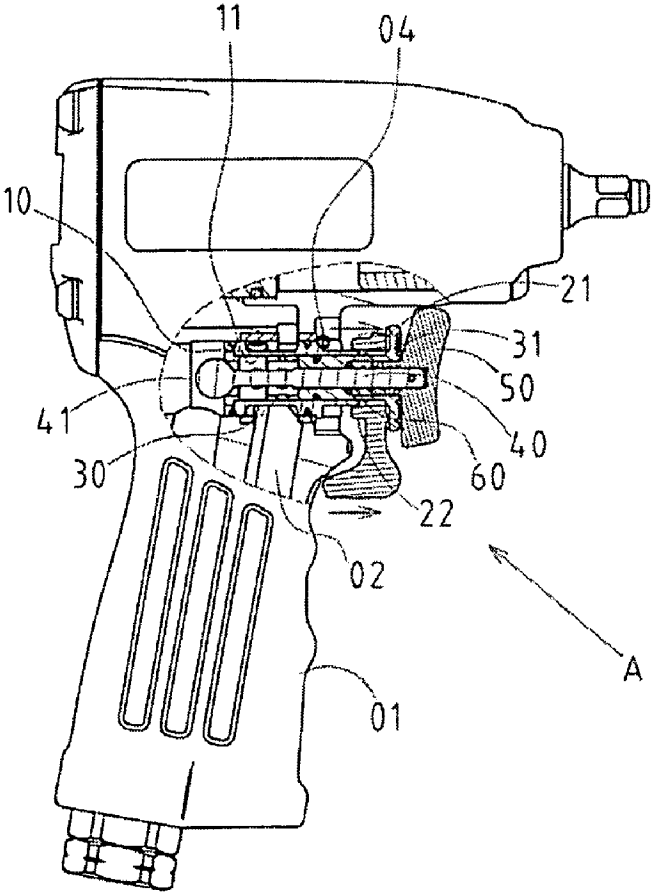
FIG. 6 shows a sectional view of the reversible control valve of the present invention along line A-A of FIG. 7, the toggle switch of the switchover bar being adjusted to face down.
Figure 9:
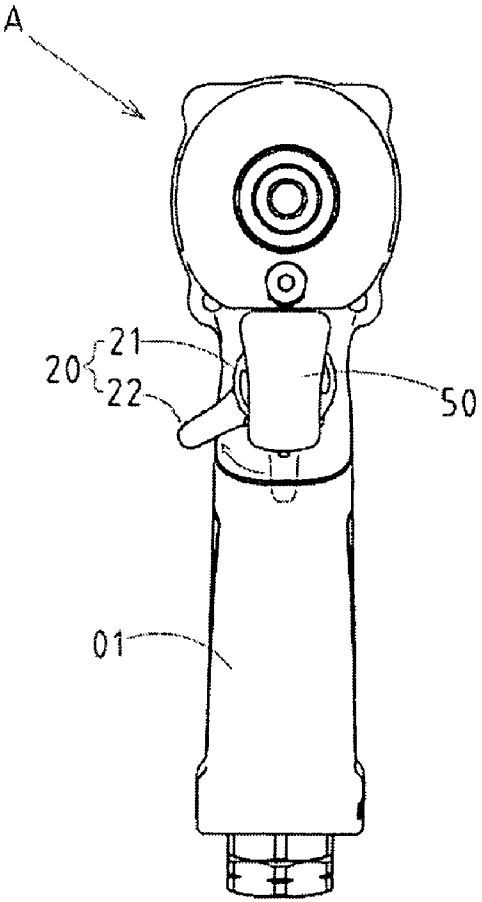
FIG. 9 shows a front elevation view of the pneumatic tool in the FIG. 8.
Figure 8:
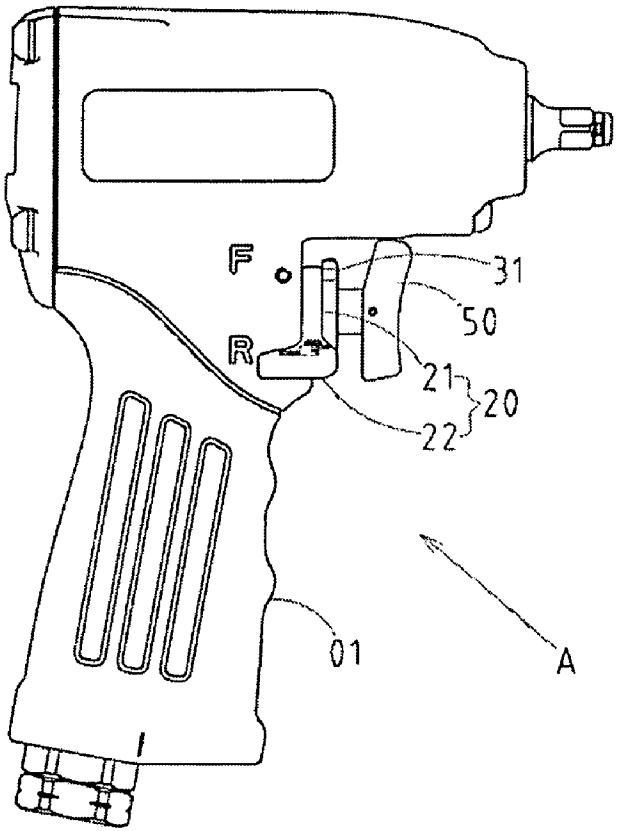
FIG. 8 shows a side elevation view of the parts of the reversible control valve of the present invention, the toggle switch of the switchover bar being adjusted to the left side of the handle.

As shown in FIG. 6, when the structure needs to be switched to the structure for left-handed users, the users may pull the switch bar 20 toward external trigger 50. Because there is a distance W between the trigger and the control wheel of the speed-adjusting valve 30, it is achieved by this action. When the switchover bar 20 is pulled out to a preset distance, the combination and position section 23 inside its connecting section 21 can be released from the valve bar positioning section 14 of the reversible control valve 10, and the elastic component 60 is pressed and restored with its elasticity. As shown in FIGS. 7 and 9, the toggle switch 22 of the switchover bar 20 can be adjusted to the left side (as shown in the figures) of the handle 01 and can be switched to the structure for the left-handed users. At this time, the pulling force of the switchover bar 20 may be released, because at this angle, the combination and position section 23 and the valve bar positioning section 14 is facing each other. When the switchover bar 20 uses the restoring elastic of the elastic component 60 to reposition inward, the position may be restored through the coordination from both parts.

Figure 10:
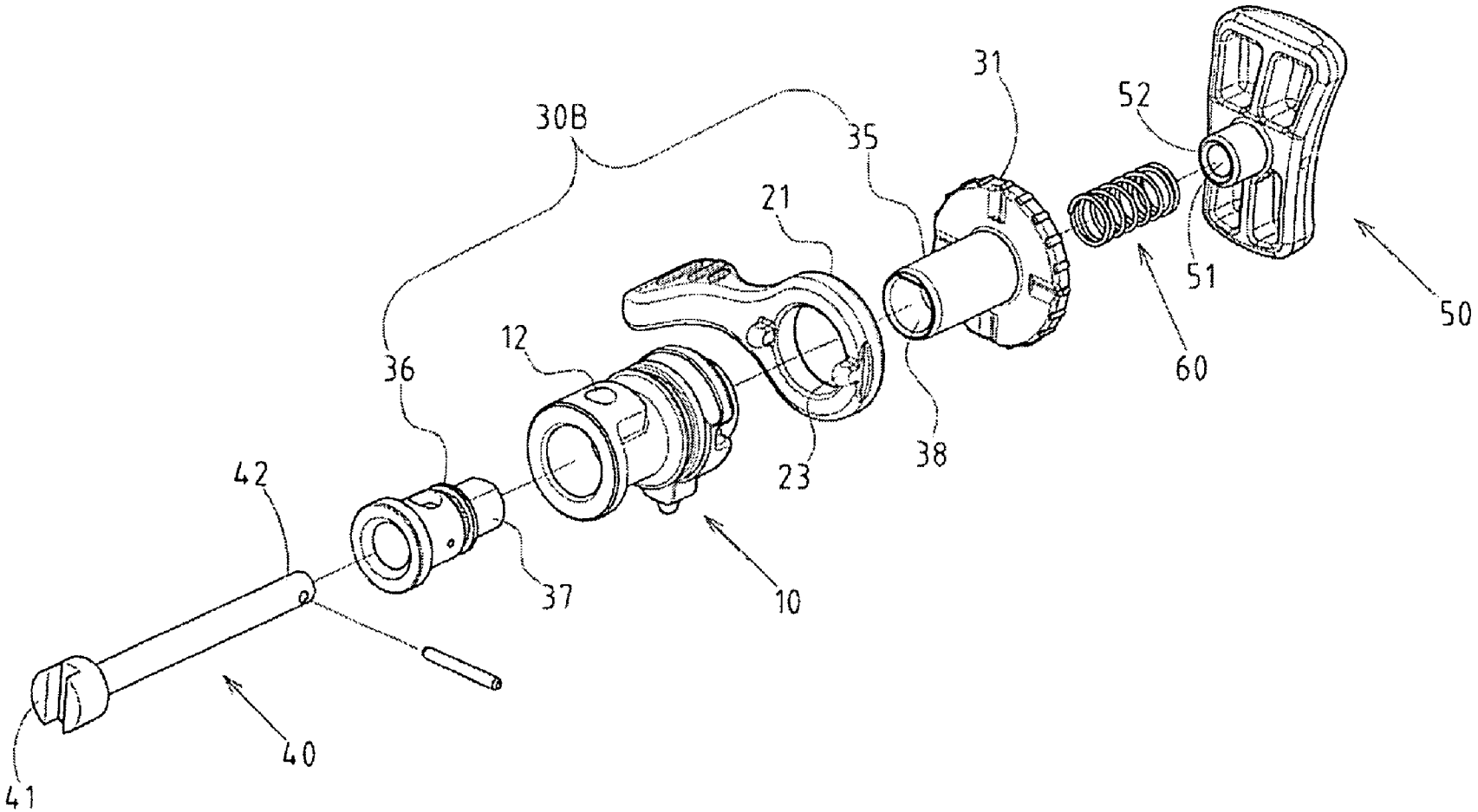
FIG. 10 shows an exploded perspective view of the structure of speed-adjusting valve of the present invention.
Figure 11:
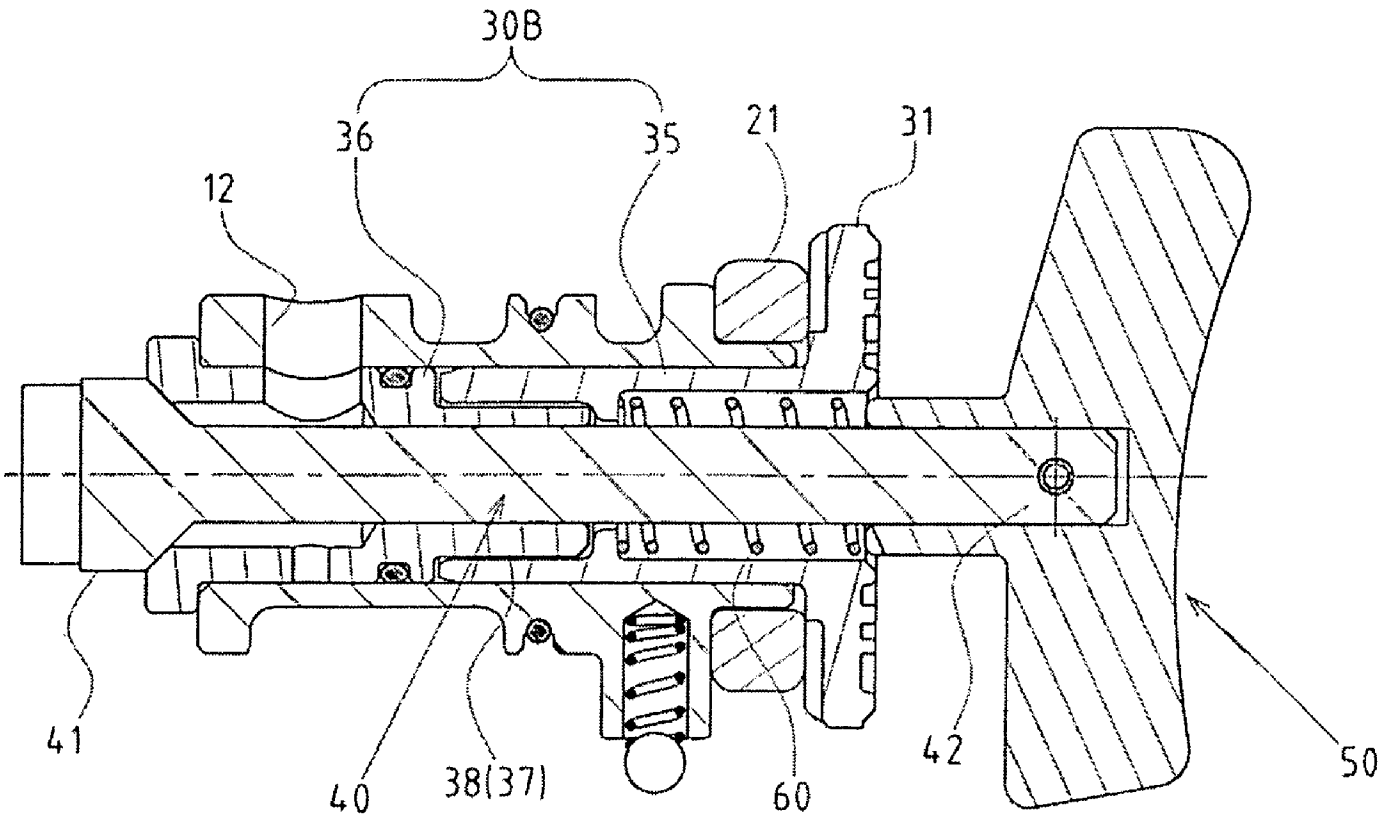
FIG. 11 shows a sectional view of the structure of the speed-adjusting valve of the present invention.

As shown in FIGS. 10, 11, the speed-adjusting valve 30B mentioned above can also be the structure made of two sections, which means, it can be made by a front valve 35 and a back valve 30B of the speed-adjusting valve 30B. Among them, the space between the back valve 36 and the front valve 35 may be positioned by the connection of the protruding tube 37 and the insert slot 38. By the combination of these two sections, it can assemble another preferred model for speed-adjusting valve 30B.

Figure 12:
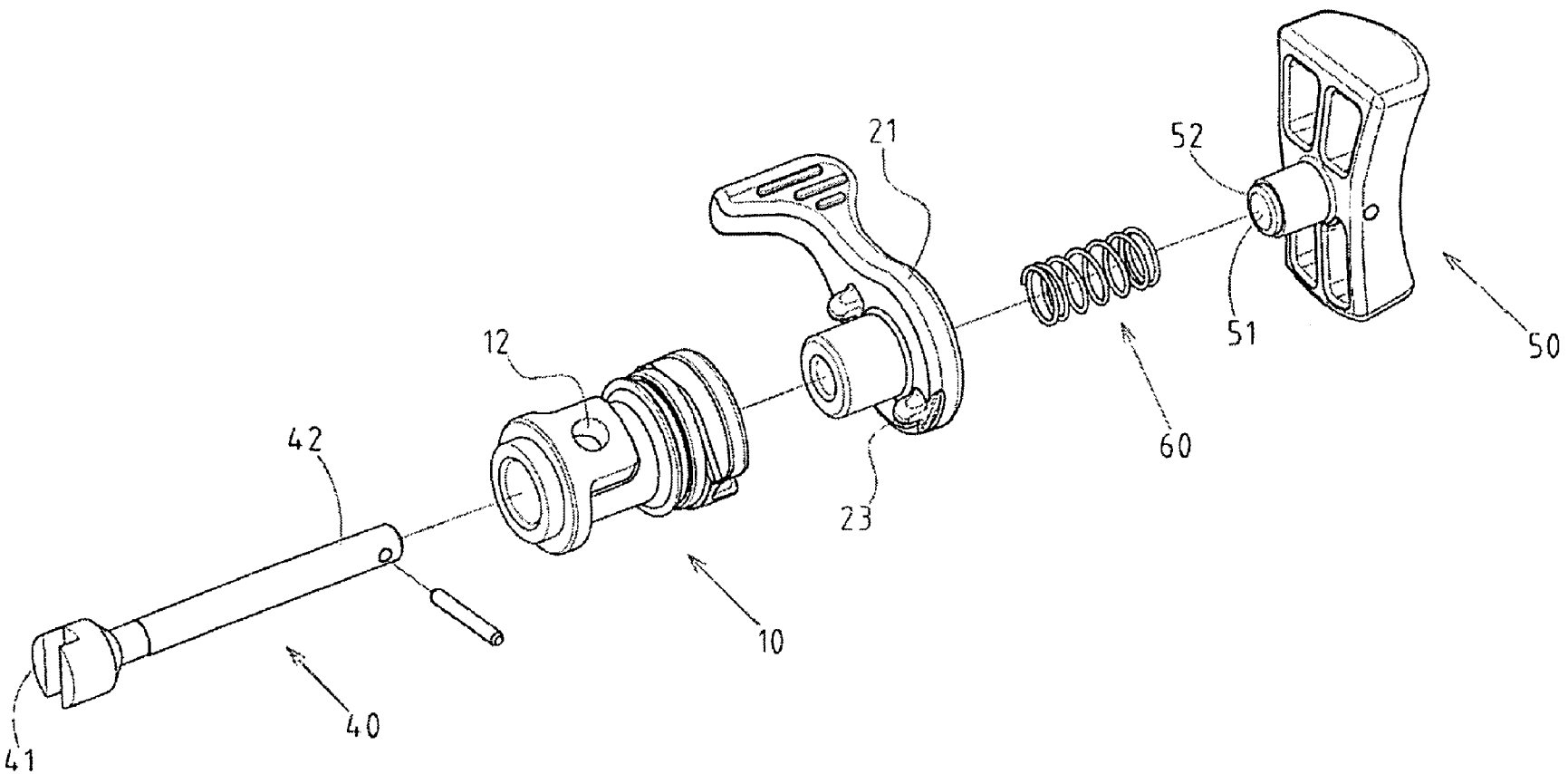
FIG. 12 shows an exploded perspective view of the structure of the reversible control valve of another embodiment of the present invention.
Figure 13:
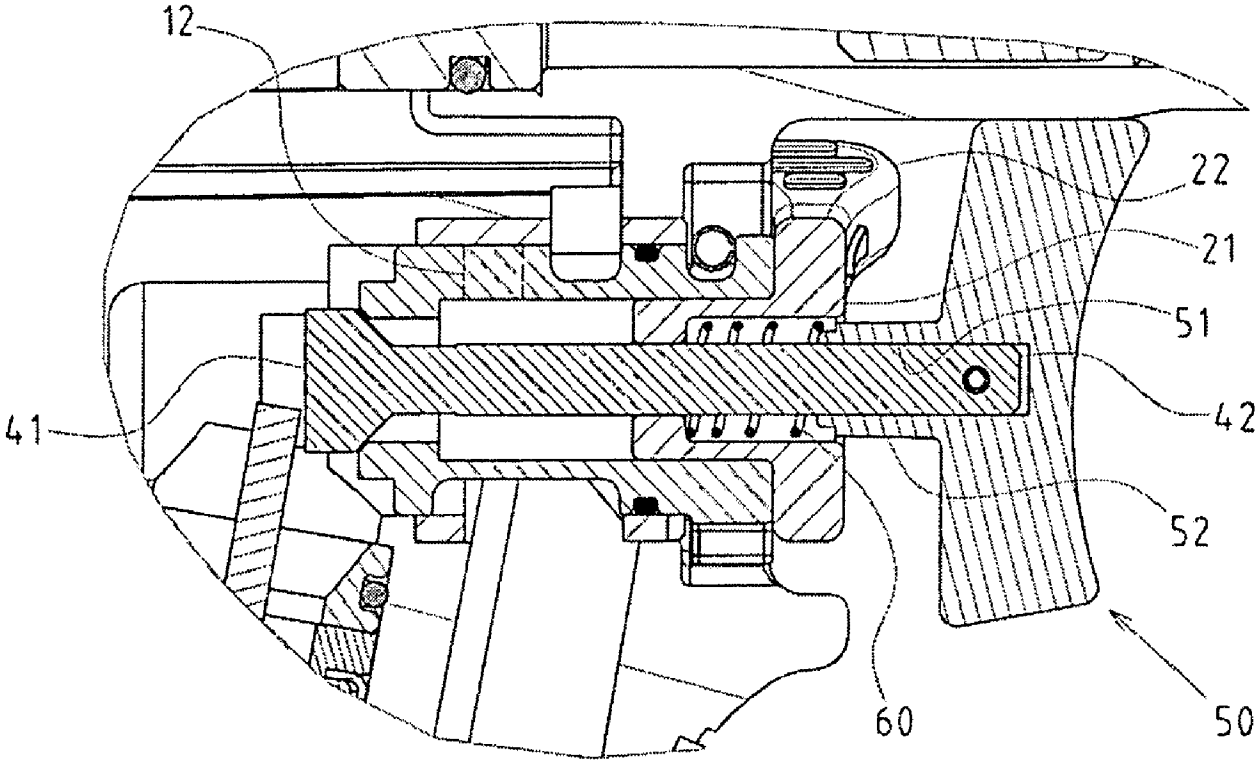
FIG. 13 shows a sectional view of the structure of the reversible control valve of another embodiment of the present invention.

As shown in FIGS. 12 and 13, the structure of the reversible control valve of the present invention can also be the speed-adjusting valve 30. By so doing, its combination is shown in FIG. 13, its connecting section 21 of the switchover bar 20 being placed against the reversible control valve 10. It can achieve the limiting position by the pushing the sleeving hole 51 against the elastic component 60.

Figure 14:
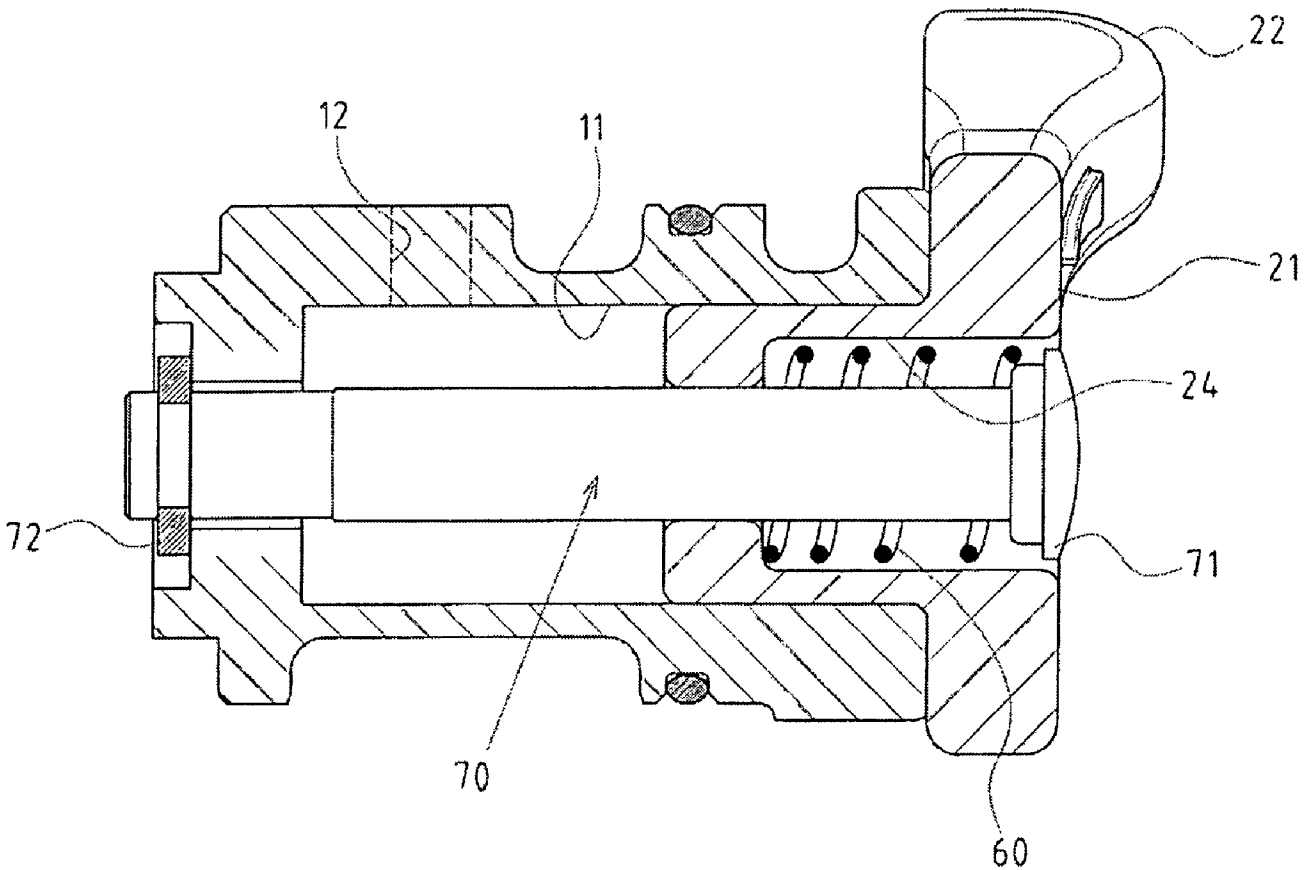
FIG. 14 shows a sectional view of the structure of the reversible control valve of another embodiment of the present invention.

As shown in FIG. 14, the structure of reversible control valve disclosed in the present invention can be the structural space of speed-adjusting valve 30 and the trigger 50, which means, the position for the reversible control valve is not limited to the structure that has the same position as the trigger. A through slit 11 is placed in the center of the reversible control valve 30, and it has an air hole 12 inside. The switchover bar 20, which includes a connecting section 21 and a toggle switch 22, and the connecting section 21 are placed on the external end of the reversible control valve 30. The connecting section has combination and position section that can be positioned with the valve bar positioning section on the external end of the reversible control valve 30 (which is the same as the 23 and 14 in FIG. 2). The toggle switch 22 is extended toward one side. The elastic component 60 is placed in the preset area of the switchover bar 20 (in this embodiment, structure of an expanding groove 24 is placed on the external end of the switchover bar), and by so doing to make the switchover restore its position.

The switchover bar 20 of the present embodiment can be limited and by not coming off a positioning shaft 70, such as by an expanding edge 71 formed on the external end of the positioning shaft 70 of the present embodiment to block the external end of the elastic component 60. A buckle 72 or bolt may be used inside the positioning shaft 70 to block the inside of the reversible control valve 30 so that the positioning shaft 70 is positioned. By this design, when the force of the switchover bar 20 is placed on the elastic component 60 (the switchover bar is pulled outward in this embodiment), it breaks the combination and position section of the switchover bar 20 away from the valve bar positioning section of the reversible control valve 30. When turning the switchover bar 20 to preset area, the elastic component 60 may be repositioned and makes the combination and position section of the switchover bar 20 be positioned with the valve bar positioning section of the reversible control valve 30.

We claim:

1. An apparatus comprising:

a pneumatic tool having a reversible control valve, said pneumatic tool having an air inlet channel, said reversible control valve having a center and an outside and an inside and an external end, said center having a through slit formed therein, said reversible control valve being turnably positioned on said air inlet channel, said reversible control valve having an air hole therein, said reversible control valve having a handle with a protruding tube on an external side thereof, said reversible control valve having a valve bar positioning section positioned thereon;

a switchover bar having a connecting section and a toggle switch, said connecting section positioned on said outside of said reversible control valve, said connecting section having a combination and position section positioned with said valve bar positioning section on said external end of said reversible control valve, said toggle switch extending toward one side of said connecting section;

a trigger bar having stick rolls extending through said through slit of said reversible control valve, said trigger bar having a limit block positioned therein so as to block said inside of said reversible control valve such that said trigger cannot roll outwardly, said trigger bar having an external side protruding outwardly so as to form a trigger connector;

a trigger connected to said trigger connector; and an elastic component positioned in an area of said switchover bar so as to urge said switchover bar to a position.

2. The apparatus of claim 1, said valve bar positioning section and said combination and position section being a concave slot and a protruding block.

3. The apparatus of claim 2, further comprising:

a speed-adjusting valve attached to said through slit of said reversible control valve, said speed-adjusting valve turnable and rollable in an axial direction, said speed-adjusting valve having a control wheel on an external end thereof urging against the external side of said connecting section of said switchover bar.

4. An apparatus comprising:

a pneumatic tool having a handle with an air inlet channel, said air inlet channel having a horizontal slot thereon;

a reversible control valve formed of a hollow cylinder with a through slit in a center thereof, said reversible control valve positioned in said horizontal slot, said reversible control valve having an axle positionable by bolt bolted horizontally to said handle, said reversible control valve having an air hole in an inner wall thereof, said reversible control valve being a protruding tube at an external end thereof, said protruding tube extending to an external side of said handle, said reversible control valve having a valve bar positioning section positioned on an external side thereof a switchover bar having a connecting section and a toggle switch, said connecting section being a round cylinder connected to said protruding tube, said connecting section having a combination and position section on an inside thereof, said combination and position section being positioned with said valve bar on an outside of said reversible control valve, said toggle switch facing one side of said handle, said toggle switch being switchable so as to turn with said reversible control valve so as to change a relative angle of said air hole;

a speed-adjusting valve of a hollow cylindrical shape, said speed-adjusting valve positioned in said through slit so as to turn and roll in an axial direction, said speed-adjusting valve having a control wheel on an external side thereof, said control wheel having an expanded outer diameter, said control wheel positioned on an outside of said connecting section of said switchover bar so as to prevent said speed-adjusting valve from rolling inwardly and to limit a movement of said switchover bar, said speed-adjusting valve having a through hole in a center thereof, said through hole having a section of expanded diameter on an outside thereof, said section of expanded diameter defining a shoulder;

a trigger bar having stick rolls extending through said through hole of said speed-adjusting valve, said trigger bar having a limit block positioned therein so as to block said through slit of said reversible control valve so as to prevent said trigger bar from rolling outwardly, said trigger bar having an external side protruding outwardly from an outside of said handle so as to form a trigger connector;

a trigger having a button-shaped body, said trigger having an inside connected to an external end of said trigger bar, said trigger and said control wheel having a space therebetween; and an elastic component positioned between said shoulder and an internal surface of said trigger so as to urge said trigger outwardly, said elastic component pushing said speed-adjusting valve inwardly such that said control wheel pushes against said connecting section, said combination and position section being positioned with the valve bar positioning section.

5. The apparatus of claim 4, said valve bar positioning section having a pair of concave slots positioned on an opposite sides of said protruding tube, said combination and position section being protruding blocks positioned on opposite sides of said connecting section.

6. The apparatus of claim 4, said limit block being an expanded round ball.

7. The apparatus of claim 4, said elastic component being a spiral spring.

8. An apparatus comprising:

a pneumatic tool having an air inlet channel;

a reversible control valve positioned on said air inlet channel, said reversible control valve having an axle, said reversible control valve having a through slit positioned in a center thereof, said reversible control valve having an air hole positioned therein, said reversible control valve having a handle extending therefrom, said handle having a protruding tube positioned on an external side thereof, said external side having a valve bar positioning section placed thereon;

a switchover bar having a connecting section and a toggle switch, said connecting section positioned on an outside of said reversible control valve, said connecting section having a combination and position section positioned with said valve bar positioning section on an external end of said reversible control valve, said toggle switch extending toward one side of said connecting section;

a positioning shaft placed in said through slit of said reversible control valve so as to limit a movement of said switchover bar; and an elastic component positioned in an area of said switchover bar so as to urge against said switchover bar.

9. The apparatus of claim 8, said valve bar positioning section and said combination and position section being a concave slot and a protruding block.

10. The apparatus of claim 8, further comprising:

a speed-adjusting valve positioned in said through slit, said speed-adjusting valve being turnable and rollable in an axial direction, said speed-adjusting valve having a control wheel on an external side thereof, said control wheel pushing against an outside of said connecting section of said switchover bar so as to limit a movement of said speed-adjusting valve and said switchover valve.

11. The apparatus of claim 8, said positioning shaft having an expanded edge formed on an external end thereof so as to block an external end of said elastic component, said positioning shaft having a buckle or bolt therein so as to block an inside of said reversible control valve and to position said positioning shaft.

12. An apparatus comprising:

a pneumatic tool having an air inlet channel;

a reversible control valve positioned on said air inlet channel, said reversible control valve having a turnable axle, said reversible control valve having a through slit in a center thereof, said reversible control valve having an air hole therein, said reversible control valve having a handle extending therefrom, said handle having a protruding tube placed on an external side thereof, said external side having a valve bar positioning section thereon;

a switchover bar having a connecting section and a toggle switch, said connecting section positioned on an outside of said reversible control valve, said connecting section having a combination and position section positioned with said valve bar positioning section, said toggle switch extending toward one side of said connecting section; and an elastic component placed in an area of said switchover bar so as to position said switchover bar, said switchover bar urging against said elastic component so as to break said combination and position section away from said valve bar positioning section.

* * * * *